US006249300B1

(12) United States Patent
Kerr et al.

(10) Patent No.: US 6,249,300 B1
(45) Date of Patent: Jun. 19, 2001

(54) METHOD AND APPARATUS FOR POSITIONING A WRITING ASSEMBLY OF AN IMAGE PROCESSING APPARATUS

(75) Inventors: Roger S. Kerr, Brockport; Robert W. Spurr, Rochester; Thomas A. Mackin, Hamlin; Kurt M. Sanger, Rochester; David F. Dalfonso, Victor, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/354,005

(22) Filed: Jul. 15, 1999

(51) Int. Cl.[7] ..... B41J 25/304
(52) U.S. Cl. ..... 347/198
(58) Field of Search ..... 346/139 D; 347/37, 347/198, 30, 264, 232

(56) References Cited

U.S. PATENT DOCUMENTS

| | | |
|---|---|---|
| 3,950,766 | 4/1976 | Erlichman et al. . |
| 4,044,881 | 8/1977 | Chai et al. . |
| 4,076,111 | 2/1978 | Robinson et al. . |
| 4,117,341 | 9/1978 | Persson . |
| 4,137,491 | 1/1979 | Bartley et al. . |
| 4,264,220 | 4/1981 | Okeuoglu . |
| 4,305,674 | 12/1981 | Velazquez . |
| 4,312,007 | 1/1982 | Winfield . |
| 4,329,051 | 5/1982 | Chamran et al. . |
| 4,395,742 | 7/1983 | Ostroff . |
| 4,408,907 | 10/1983 | Barnardis . |
| 4,488,051 | 12/1984 | Brown et al. . |
| 4,511,328 | 4/1985 | Ramge et al. . |
| 4,528,607 | 7/1985 | Thompson . |
| 4,539,614 | 9/1985 | Thompson . |
| 4,602,882 | 7/1986 | Akazawa . |
| 4,613,245 | 9/1986 | Ikeda et al. . |
| 4,630,145 | 12/1986 | Thompson et al. . |
| 4,643,596 | 2/1987 | Shimada et al. . |
| 4,714,361 | 12/1987 | Yamakawa et al. . |

(List continued on next page.)

OTHER PUBLICATIONS

Compumotor Digiplan, Positioning Control Systems and Drives, 1993–94, pp. A6–A9.

*Primary Examiner*—N. Le
*Assistant Examiner*—K. Feggins
(74) *Attorney, Agent, or Firm*—David A. Novais; Nelson Adrian Blish

(57) ABSTRACT

An image processing apparatus (10) comprises an imaging drum (300) for holding print media (32) and donor material (36) in registration on the imaging drum (300). A print head (500), driven by a lead screw (250) and stepper motor, moves along a line parallel to a longitudinal axis (X) of the imaging drum (300) as the imaging drum (300) rotates. The print head (500) is brought repeatably to a mechanical registration position using sensors. For coarse positioning, the print head (500) is moved to a first linear sensor position, with the drive motor operated in full-step mode. For fine positioning, the drive motor is then operated in microstepping mode, during which a second sensor detects rotational orientation by detecting a rotational indicator mounted on the lead screw (250). The rotational indicator permits straightforward adjustment for fine-tuning, being adjustable to any one of a number of fixed positions relative to lead screw rotation.

11 Claims, 10 Drawing Sheets

U.S. PATENT DOCUMENTS

| | | | | |
|---|---|---|---|---|
| 4,785,312 | | 11/1988 | Toyomura . | |
| 4,897,589 | | 1/1990 | Fujiwara et al. . | |
| 4,948,279 | | 8/1990 | Ikoma et al. . | |
| 4,967,654 | | 11/1990 | Strong et al. . | |
| 5,007,751 | | 4/1991 | Yamakawa . | |
| 5,047,796 | | 9/1991 | Tagami et al. . | |
| 5,074,690 | | 12/1991 | Del Signore, II et al. . | |
| 5,083,143 | | 1/1992 | Hoffman . | |
| 5,090,829 | | 2/1992 | Lee et al. . | |
| 5,107,365 | | 4/1992 | Ota . | |
| 5,146,242 | | 9/1992 | Zielinski . | |
| 5,160,938 | | 11/1992 | Fargo et al. . | |
| 5,164,742 | | 11/1992 | Baek et al. . | |
| 5,258,776 | | 11/1993 | Guy et al. . | |
| 5,262,937 | * | 11/1993 | Mackin et al. | 347/232 |
| 5,268,708 | | 12/1993 | Harshbarger et al. . | |
| 5,274,226 | | 12/1993 | Kidwell et al. . | |
| 5,355,155 | | 10/1994 | Mistyurik . | |
| 5,392,623 | | 2/1995 | Cueman et al. . | |
| 5,410,338 | * | 4/1995 | Jadrich et al. | 347/264 |
| 5,453,777 | | 9/1995 | Pensavecchia et al. . | |
| 5,491,595 | | 2/1996 | Alsborg et al. . | |
| 5,491,633 | | 2/1996 | Henry et al. . | |
| 5,506,502 | | 4/1996 | Maennle . | |
| 5,518,324 | | 5/1996 | Campbell et al. . | |
| 5,580,586 | | 12/1996 | Yokoyama . | |
| 5,668,580 | | 9/1997 | Chan et al. . | |
| 5,724,084 | | 3/1998 | Hevenor . | |
| 5,783,939 | | 7/1998 | Lippmann et al. . | |
| 5,829,889 | | 11/1998 | Kerr et al. . | |
| 6,019,452 | * | 2/2000 | Hirano et al. | 347/30 |

* cited by examiner

METHOD AND APPARATUS FOR POSITIONING A WRITING ASSEMBLY OF AN IMAGE PROCESSING APPARATUS

CROSS-REFERENCE TO RELATED APPLICATIONS

The present applications are related to U.S. application Ser. No. 09/316,366 filed May 18, 1999, entitled REMOVABLE LEAD SCREW ASSEMBLY FOR AN IMAGE PROCESSING APPARATUS; U.S. Ser. No. 09/080,841 filed May 18, 1998, entitled MAGNETICALLY HELD MOTOR STOP and U.S. application Ser. No. 09/344,917 filed Jun. 25, 1999 entitled A METHOD FOR CHANGING FOCUS AND ANGLE OF A MULTICHANNEL PRINTHEAD.

FIELD OF THE INVENTION

The present invention relates to the control of a writing assembly of an image processing apparatus, and more specifically, the control of print head registration in an image processing apparatus of the lathe bed scanning type.

BACKGROUND OF THE INVENTION

Pre-press color proofing is a procedure that is used by the printing industry for creating representative images of printed material, without the high cost and time that is required to actually produce printing plates and set up a high-speed, high-volume, printing press to produce a single example of an intended image. These intended images may require several corrections and may need to be reproduced several times to satisfy the requirements of customers, resulting in a large loss of profits. By utilizing pre-press color proofing, time and money can be saved.

One such commercially available image processing apparatus, which is depicted in commonly assigned U.S. Pat. No. 5,268,708, is an image processing apparatus having half-tone color proofing capabilities. This image processing apparatus is arranged to form an intended image on a sheet of print media by transferring dye from a sheet of dye donor material to the print media by applying a sufficient amount of thermal energy to the dye donor material to form an intended image. This image processing apparatus is comprised generally of a material supply assembly or carousel, a lathe bed scanning subsystem (which includes a lathe bed scanning frame, a translation drive, a translation stage member, a print head, and a vacuum imaging drum), and print media and dye donor material exit transports.

The operation of the image processing apparatus comprises metering a length of the print media (in roll form) from the material assembly or carousel. The print media is then measured, cut into sheet form of the required length, transported to the vacuum imaging drum, registered, wrapped around and secured onto the vacuum imaging drum. Next a length of dye donor material (in roll form) is also metered out of the material supply assembly or carousel, measured and cut into sheet form of the required length. It is then transported to and wrapped around the vacuum imaging drum, such that it is superposed in the desired registration with respect to the print media (which has already been secured to the vacuum imaging drum).

After the dye donor material is secured to the periphery of the vacuum imaging drum, the scanning subsystem or write engine provides the scanning function. This is accomplished by retaining the print media and the dye donor material on the spinning vacuum imaging drum while it is rotated past the print head that will expose the print media. The translation drive then traverses the print head and translation stage member axially along the vacuum imaging drum, in coordinated motion with the rotating vacuum imaging drum. These movements combine to produce the intended image on the print media.

After the intended image has been written on the print media, the dye donor material is then removed from the vacuum imaging drum. This is done without disturbing the print media that is beneath it. The dye donor material is then transported out of the image processing apparatus by the dye donor material exit transport. Additional dye donor materials are sequentially superposed with the print media on the vacuum imaging drum, then imaged onto the print media as previously mentioned, until the intended image is completed. The completed image on the print media is then unloaded from the vacuum imaging drum and transported to an external holding tray on the image processing apparatus by the receiver sheet material exit transport.

The scanning subsystem or write engine of the lathe bed scanning type comprises the mechanism that provides the mechanical actuators for imaging drum positioning and motion control to facilitate placement, loading onto, and removal of the print media and the dye donor material from the vacuum imaging drum. The scanning subsystem or write engine provides the scanning function by retaining the print media and dye donor material on the rotating vacuum imaging drum, which generates a once per revolution timing signal to the data path electronics as a clock signal while the translation drive traverses the translation stage member and print head axially along the vacuum imaging drum in a coordinated motion with the vacuum imaging drum rotating past the print head. This is done with positional accuracy maintained, to allow precise control of the placement of each pixel, in order to produce the intended image on the print media.

The translation drive permits relative movement of the print head by synchronizing the motion of the print head and stage member such that the required movement is made smoothly and evenly throughout each rotation of the drum. A clock signal generated by a drum encoder provides the necessary reference signal accurately indicating the position of the drum. This coordinated motion results in the print head tracing out a helical pattern around the periphery of the drum. The above mentioned motion is accomplished by means of a dc. servo motor and encoder which rotates a lead screw that is typically, aligned parallel with the axis of the vacuum imaging drum.

The print head is selectively locatable with respect to the translation stage member, thus it is positioned with respect to the vacuum imaging drum surface. By adjusting the distance between the print head and the vacuum imaging drum surface, as well as an angular position of the print head about its axis using adjustment screws, an accurate means of adjustment for the print head is provided.

The translation stage member and print head are attached to a rotatable lead screw (having a threaded shaft) by a drive nut and coupling. The coupling is arranged to accommodate misalignment of the drive nut and lead screw so that only rotational forces and forces parallel to the lead screw are imparted to the translation stage member by the lead screw and drive nut. A DC servo drive motor induces rotation to the lead screw moving the translation stage member and print head along the threaded shaft as the lead screw is rotated. This achieves a movement of the print head relative to a longitudinal axis of the vacuum imaging drum. The lateral directional movement of the print head is controlled by switching the direction of rotation of the DC servo drive motor and thus the lead screw.

Although the presently known and utilized image processing apparatus is satisfactory, it is not without drawbacks. Registration of the print head, that is, positioning the print head repeatably in the precise location for the beginning of a scan, is a significant problem. Colorant transfer action prints dots (nominally 4–8 microns in diameter) on the receiver medium, with the dots positioned at a precise distance from each other (with dot centers nominally 10–12 microns apart). To maintain correct registration of dots from one color separation to the next, the print head must be precisely and repeatably positioned at identical coordinates for each pass. Relative to the imaging receiver that is secured on the drum surface, there is some tolerance for initially locating the registration position for start of scan. However, once an initial registration position is identified, the image processing apparatus requires precise repeatability, so that each subsequent registration operation brings the print head to the same fixed reference point, within very close tolerances.

Registration must be performed multiple times for each color roof, once at the beginning of each component color pass. To maximize throughput (productivity) of the device, it is advantageous to be able to perform registration as quickly as possible.

With existing color proofing systems, such as the system noted above, head registration requires a combination of high-cost components including a servo loop with an encoder, a fine-resolution lead screw, and a precision sensor to indicate linear travel. The conventional method used requires driving the translation assembly to a precise position as indicated by a linear-motion sensor, then using the servo loop to move the translation assembly back, a precise number of encoder counts, to the actual registration position.

Lead screw positioning solutions for locating a print head at a home position are well-known in the art. Among patents of particular interest that disclose various aspects and improvements on conventional head registration are the following:

U.S. Pat. No. 5,160,938 discloses a method and an apparatus for homing a precision print head relative to an imaging drum in an ink jet printer. This method locates a relative home position by using a sensor placed in the direct path of an ink jet. Repeated adjust/test cycles are used to zero in on the home position.

U.S. Pat. No. 5,074,690 discloses a head positioning and homing system for a standard impact-type printer. This method uses a timing strip built into the printer assembly itself, with a position sensor that travels with the print head carriage.

U.S. Pat. No. 4,488,051 discloses a method for homing a load element driven by a lead screw (in the preferred embodiment, this method is used in the control apparatus for positioning a diffraction grating in a spectrophotometer). Notably, this method achieves fine-tuning of the home position using a sensor for rotational position of a flag that is fixedly mounted to rotate with the lead screw.

U.S. Pat. No. 4,117,341 discloses a method for homing a lens component, driven by a lead screw, used in ophthalmic instrumentation. Here, a mechanical flag element travels with the moving lens assembly, triggering an optical sensor when the assembly reaches a reference home position.

U.S. Pat. No. 4,329,051 discloses a method for homing the position of a diffraction grating in a spectrophotometer using a control segment driven by a lead screw. Here, a mechanical stop is employed to indicate the home position of the control segment.

While the above patents disclose methods used for print head or optical component homing in a lead screw-driven device, none of these patents provide for a method or apparatus which enables the precise addressability required for registration of a print head in an imaging system that scans with a resolution at 2400 dots per inch or higher. Also, none of the above patents disclose or suggest a method or apparatus that allows straightforward adjustment of a sensor component position for optimal timing and precision.

SUMMARY OF THE INVENTION

The present invention is directed to overcoming one or more of the problems set forth above. Briefly summarized, according to one aspect of the present invention, the invention resides in an imaging processing apparatus of the lathe-bed scanning type, where a print head is secured to a translation stage member that, driven by a lead screw, provides linear movement of the print head. The present invention provides precision registration for the print head, employing positioning and sensing mechanisms and control logic that first back up the print head to a coarse, linear reference position near the end of travel and out of the way of the imaging drum and media handling components; advance the print head a precise distance to a coarse writing position; and provide fine-tuning using incremental rotation of the lead screw to bring the translation stage member to a mechanical registration position, at which point the print head images its first dot. To facilitate adjustment of the sensing components for fine positioning and to optimize system timing, this invention utilizes an adjustable rotational flag that can be disposed in any one of a discrete number of angular positions on the lead screw.

It is an object of the present invention to provide print head registration with precision repeatability in an image processing apparatus.

It is an advantage of the present invention that it allows print head registration to be implemented using relatively inexpensive sensors for linear and rotational motion. The present invention supports the ability for precision head registration using a lead screw having coarser resolution than with earlier systems.

It is a further advantage of the present invention that it allows print head registration under the control of machine software, minimizing the need for mechanical adjustments to effect precise registration.

It is a further advantage of the present invention that it allows adjustment of positioning sensors for print head registration, where this adjustment is made without tools.

It is a further advantage of the present invention that, for print head registration, it allows adjustment of sensing elements at the optimum position for speed, helping to boost the overall throughput of the image processing apparatus.

The present invention relates to an image processing apparatus that comprises a writing assembly operationally associated with a lead screw mechanism so as to be movable in a travel path along the lead screw mechanism; a motor which rotates the lead screw mechanism so as to move the writing assembly along the travel path; a linear sensor arrangement which detects a presence of the writing assembly at a reference point along the travel path and provides a first signal indicative thereof, a rotational sensor arrangement which detects a rotational orientation of the lead screw mechanism with respect to a fixed angular position and provides a second signal indicative thereof; and a controller which receives the first and second signals and controls the motor in response thereto to control a positioning of the writing assembly along the travel path.

The present invention further relates to an image processing apparatus that comprises a writing assembly which is mounted on a lead screw mechanism so as to be movable in opposite directions along a travel path defined by the lead screw mechanism; a motor which rotates the lead screw mechanism to move the writing assembly along the travel path; a first sensor which detects a presence of the writing assembly along the travel path and provides a first signal indicative thereof; a second sensor which detects a rotational orientation of the lead screw mechanism with respect to a fixed angular position and provides a second signal indicative thereof; and a controller which receives at least the first and second signals and controls the motor to position the writing assembly in a registration home position prior to a processing operation of the image processing apparatus.

The present invention also relates to a method of controlling a position of a writing assembly of an image processing apparatus. The method comprises the steps of rotating a stepper motor associated with the writing assembly in a full step mode in a first rotational direction, so as to drive the writing assembly in a first linear direction relative to an imaging drum to a first position just past an edge of the imaging drum; sensing a detecting element on the writing assembly at the first position by way of a first sensor, and stopping the driving of the writing assembly in response thereto; rotating the stepper motor in a full step mode in a second rotational direction to drive the writing assembly in a second linear direction one full step at a time until the first sensor senses an edge of the detecting element; and stopping the rotation of the stepper motor in the second rotational direction at a next step position following the sensing of the edge of the detecting element so as to provide for linear homing of the writing assembly.

The present invention further relates to a method of controlling a position of a writing assembly of an image processing apparatus which comprises the steps of rotating a lead screw mechanism so as to drive a writing assembly operationally associated with the lead screw mechanism in a linear direction along a travel path; sensing a presence of the writing assembly at a reference point along the travel path and providing a first signal indicative thereof; detecting a rotational orientation of the lead screw mechanism with respect to fixed angular position and providing a second signal indicative thereof; and controlling a rotation of the lead screw mechanism to control a positioning of the writing assembly along the travel path based on the first and second signals.

The present invention further relates to an image processing apparatus that uses a scanning head mounted on a translation assembly with the translation assembly being movable in opposite directions along a lead screw. The image processing apparatus comprises a stepper motor that rotates the lead screw in opposite rotational directions; a controller which selectively drives the stepper motor in at least full-step and microstepping modes; a linear sensing arrangement which detects an arrival of the translation assembly at a reference point along a linear travel path of the translation assembly; and a rotational sensing arrangement which detects a rotational orientation of the lead screw relative to a fixed angular position.

The present invention further relates to a method of registering a scanning head of an image processing apparatus that uses a scanning head mounted on a translation assembly, in which the translation assembly is movable in opposite directions along a lead screw mechanism, and the lead screw mechanism is driven by a stepper motor. The method comprises the steps of: (a) moving the translation assembly in a first direction, with the stepper motor running in a full-step mode, until a sensor transition indicates that the translation assembly is detected at a linear home position; (b) moving the translation assembly in a second direction opposite to the first direction, one step at a time, until a reversed sensor transition indicates that the translation assembly is at a specific linear home position indexed by a stepper motor step, then immediately stopping the stepper motor; (c) moving the translation assembly a precise number of full steps in the second direction from the second specific linear home position; (d) rotating the stepper motor in a microstepping mode in a forward direction, until a forward rotational sensor transition indicates that a lead screw shaft of the lead screw mechanism has passed a first specific angular position; and (e) rotating the stepper motor in a microstepping mode in a reversed direction, one microstep at a time, until a reversed rotational sensor transition indicates that the lead screw shaft is at a second specific angular position, then immediately stopping the stepper motor.

DETAILED DESCRIPTION OF THE INVENTION

Figure 1:
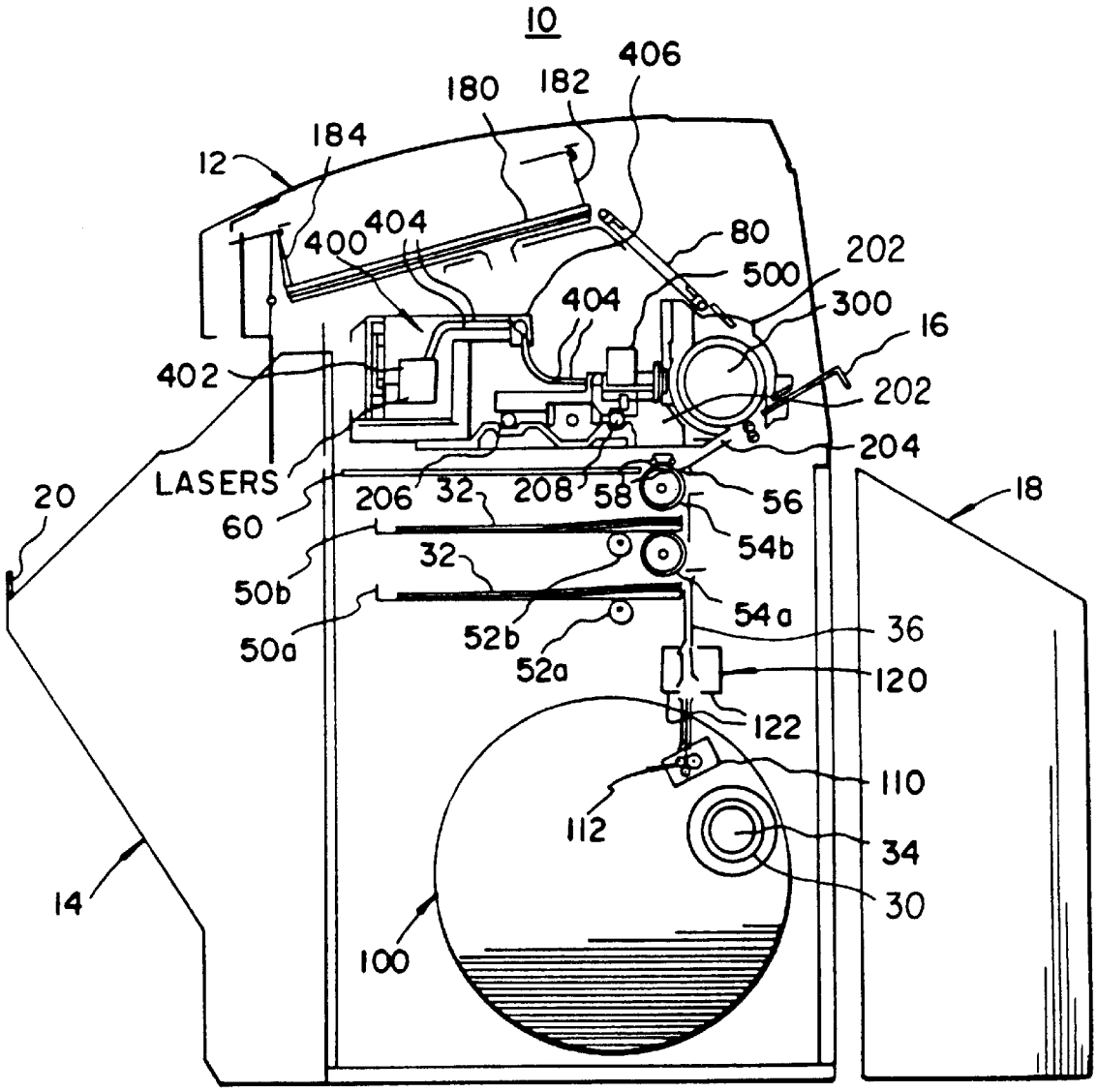
FIG. 1 is a side view in vertical cross section of an image processing apparatus.

Referring now to the drawings, wherein like reference numerals represent similar or identical parts throughout the several views, FIG. 1 illustrates an image processing apparatus 10 which can be utilized within the context of the present invention. Image processing apparatus 10 includes an image processor housing 12 which provides a protective cover. A movable, hinged image processor door 14 is attached to the front portion of the image processor housing 12 permitting access to two sheet material trays, a lower sheet material tray 50*a* and an upper sheet material tray 50*b*, that are positioned in the interior portion of image processor housing 12 for supporting print media 32, thereon. Only one of sheet material trays 50*a*, 50*b* will dispense print media 32 out of its sheet material tray to create an intended image thereon; the alternate sheet material tray either holds an alternative type of print media 32 or functions as a back up sheet material tray. In this regard, lower sheet material tray 50*a* includes a lower media lift cam 52*a* for lifting lower sheet material tray 50*a* and ultimately print media 32, upwardly toward rotatable, lower media roller 54*a* and toward a second rotatable, upper media roller 54*b* which, when both are rotated, permits print media 32 to be pulled upwardly towards a movable media guide 56. Upper sheet material tray 50*b* includes upper media lift cam 52*b* for lifting upper sheet material tray 50*b* and ultimately print media 32 towards upper media roller 54*b* which directs it towards movable media guide 56.

Movable media guide 56 directs print media 32 under a pair of media guide rollers 58 which engages print media 32 for assisting upper media roller 54*b* in directing it onto a media staging tray 60. Media guide 56 is attached and hinged to a lathe bed scanning frame 202 at one end, and is uninhibited at its other end for permitting multiple positioning of media guide 56. Media guide 56 then rotates its uninhibited end downwardly, as illustrated in the position shown, and the direction of rotation of upper media roller 54*b* is reversed for moving print media 32 resting on media staging tray 60 under the pair of media guide rollers 58, upwardly through an entrance passageway 204 and around a rotatable imaging drum 300, such as a vacuum image drum.

A roll 30 of donor roll material 34 is connected to a media carousel 100 in a lower portion of image processor housing 12. Four rolls of roll media 30 are used, but only one is shown for clarity. Each roll media 30 includes a donor roll material 34 of a different color, typically black, yellow, magenta and cyan. These donor roll materials 34 are ultimately cut into donor sheet materials 36 and passed to vacuum imaging drum 300 for forming the medium from which colorant, such as dyes, inks and pigments, imbedded therein are passed to print media 32 resting thereon. In this regard, a media drive mechanism 110 is attached to each roll 30 of donor roll material 34, and includes three media drive rollers 112 through which donor roll material 34 of interest is metered upwardly into a media knife assembly 120. After donor roll material 34 reaches a predetermined position, media drive rollers 112 cease driving the donor roll material 34 and two media knife blades 122 positioned at the bottom portion of media knife assembly 120 cut donor roll material 34 into donor sheet materials 36. Lower media roller 54*a* and upper media roller 54*b* along with media guide 56 then pass donor sheet material 36 onto media staging tray 60 and ultimately to vacuum imaging drum 300 and in registration with print media 32 using the same process as described above for passing print media 32 onto vacuum imaging drum 300. Donor sheet material 36 now rests atop print media 32 with a narrow space between the two created by microbeads imbedded in the surface of print media 32.

Laser assembly 400 includes a quantity of laser diodes 402 in its interior. Laser diodes 402 are connected via fiber optic cables 404 to a distribution block 406 and ultimately to a writing assembly, such as a print head 500. Print head 500 directs thermal energy received from laser diodes 402 causing donor sheet material 36 to pass the desired color across the gap to print media 32. Print head 500 is attached to a lead screw 250 via a lead screw drive nut 254 and a drive coupling 256 for permitting movement axially along the longitudinal axis of vacuum imaging drum 300 for transferring the data to create the intended image onto the print media 32.

For writing, vacuum imaging drum 300 rotates at a constant velocity, and print head 500 begins at one end of print media 32 and traverses the entire length of print media 32 for completing the transfer process for the particular donor sheet material 36 resting on print media 32. After print head 500 has completed the transfer process, for the particular donor sheet material 36 resting on print media 32, the donor sheet material 36 is then removed from vacuum imaging drum 300 and transferred out of image processor housing 12 via a skive or ejection chute 16. Donor sheet material 36 eventually comes to rest in a waste bin 18 for removal by the user. The above described process is then repeated for the other three rolls of roll media 30 of donor roll materials 34.

Figure 2:
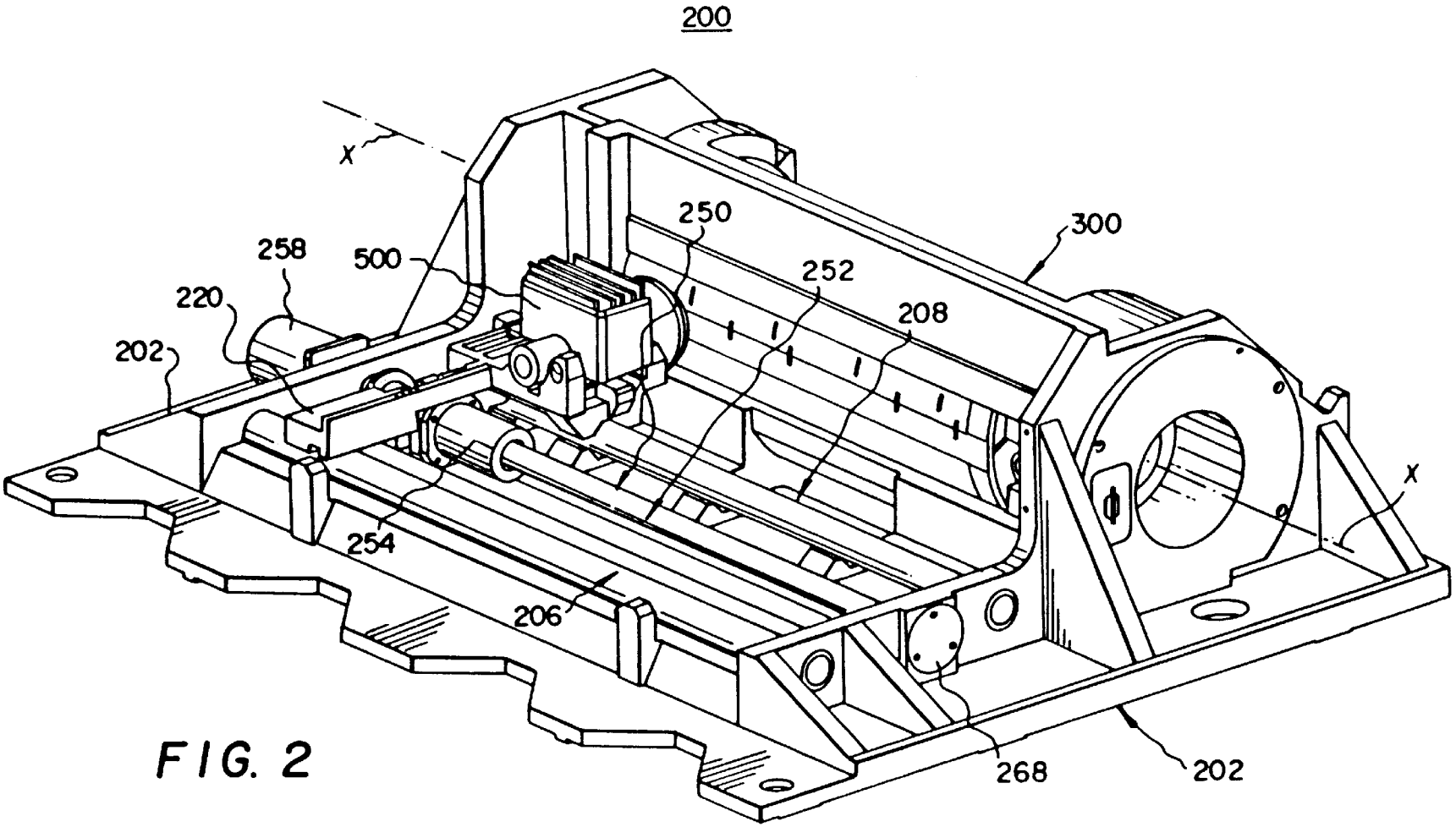
FIG. 2 is a perspective view of a lathe-bed scanning subsystem or write engine as viewed from the rear of the image processing apparatus.

Referring to FIG. 2, there is illustrated a perspective view of a lathe bed scanning subsystem 200 of image processing apparatus 10, including vacuum imaging drum 300, print head 500 and lead screw 250 assembled in a lathe bed scanning frame 202. Vacuum imaging drum 300 is mounted for rotation about an axis X in lathe bed scanning frame 202. Print head 500 is movable with respect to vacuum imaging drum 300, and is arranged to direct a beam of light to donor sheet material 36. The beam of light from print head 500 for each laser diode 402 can be modulated individually by modulated electronic signals from image processing apparatus 10, which are representative of the shape and color of the original image, so that the color on donor sheet material 36 is heated to cause volatilization only in those areas in which its presence is required on print media 32, to reconstruct the shape and color of the original image.

Print head 500 is mounted on movable translation stage member 220 which, in turn, is supported for low friction slidable movement on translation bearing rods 206 and 208. Front translation bearing rod 208 locates translation stage member 220 in the vertical and the horizontal directions with respect to axis X of vacuum imaging drum 300. Rear translation bearing rod 206 locates translation stage member 220 only with respect to rotation of translation stage member 220 about front translation bearing rod 208, so that there is no over-constraint condition of translation stage member 220 which might cause it to bind, chatter, or otherwise impart undesirable vibration or jitters to print head 500 during the generation of an intended image.

Figure 3:
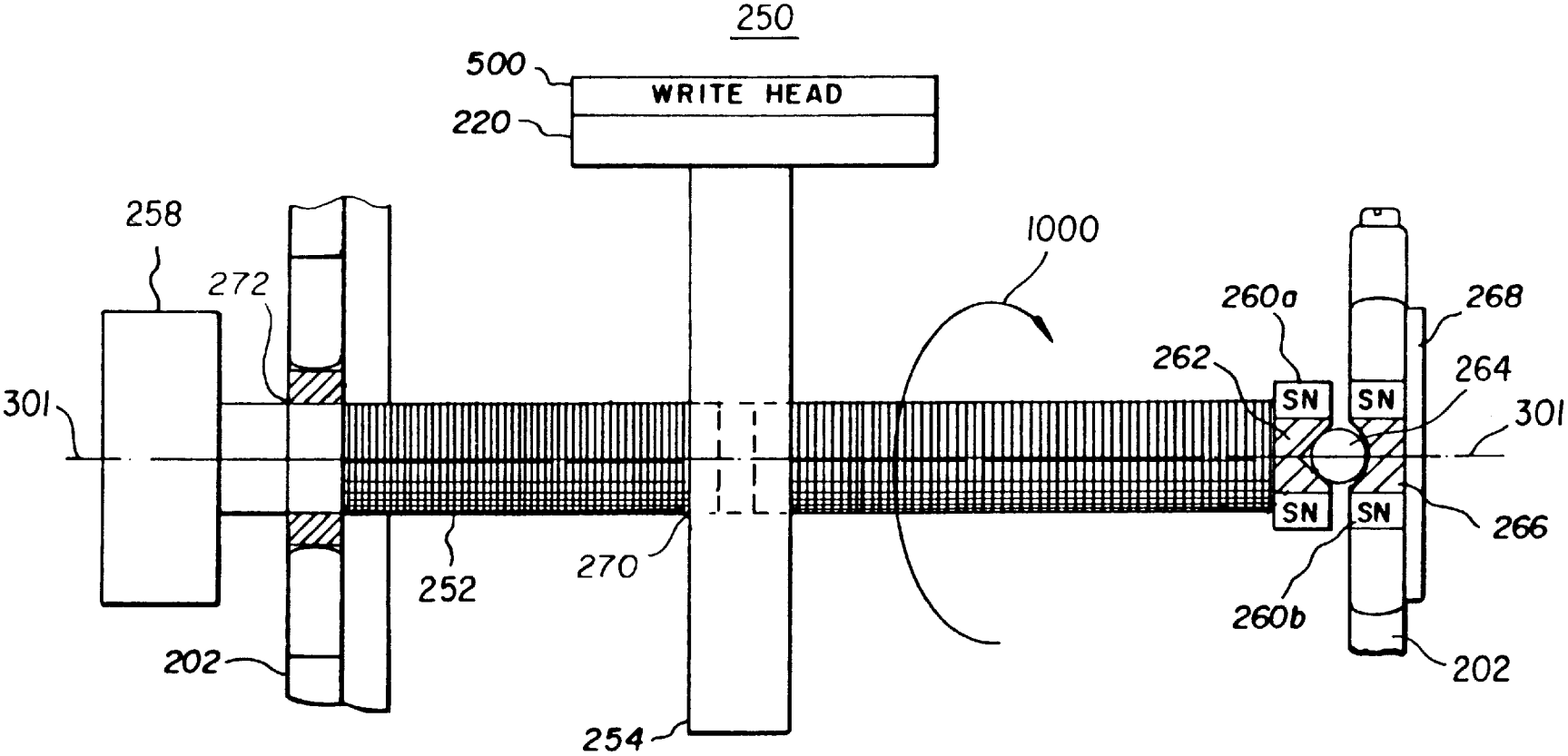
FIG. 3 is a top view in horizontal cross-section, partially in phantom, of a lead screw.

Lead screw 250 is attached to a linear drive motor 258 which is a stepper motor on its drive end and to lathe bed scanning frame 202 by means of radial bearing 272 (FIG. 3). Lead screw drive nut 254 includes grooves in its hollowed-out center portion 270 for mating with threads of threaded shaft 252 for permitting lead screw drive nut 254 to move axially along threaded shaft 252 as threaded shaft 252 is rotated by linear drive motor 258. Lead screw drive nut 254 is integrally attached to print head 500 through an end screw coupling (not shown) and translation stage member 220 at its periphery, so that as threaded shaft 252 is rotated by linear drive motor 258, lead screw drive nut 254 moves axially along threaded shaft 252, which in turn moves translation stage member 220 and ultimately print head 500 axially along vacuum imaging drum 300.

As best illustrated in FIG. 3, an annular-shaped axial load magnet 260*a* is integrally attached to the driven end of threaded shaft 252, and is in a spaced-apart relationship with another annular-shaped axial load magnet 260*b* attached to lathe bed scanning frame 202. Axial load magnets 260*a* and 260*b* are preferably made of rare-earth materials such as neodymium-iron-boron. A generally circular-shaped boss part 262 of threaded shaft 252 rests in the hollowed-out portion of the annular-shaped axial load magnet 260*a*, and includes a generally V-shaped surface at the end for receiving a ball bearing 264. A circular-shaped insert 266 is placed in the hollowed-out portion of the other annular-shaped axial load magnet 260*b*, and includes an appropriately shaped surface on one end for receiving ball bearing 264, and a flat surface at its other end for receiving an end cap 268 placed over the annular-shaped axial load magnet 260*b* and attached to lathe bed scanning frame 202 for protectively covering the annular-shaped axial load magnet 260*b* and providing an axial stop for lead screw 250. Circular shaped insert 266 is preferably made of material such as Rulon J or Delrin AF, both well known in the art.

Lead screw 250 operates as follows. Linear drive motor 258 is energized and imparts rotation to lead screw 250 about axis 301, as indicated by arrow 1000, causing lead screw drive nut 254 to move axially along threaded shaft 252. Annular-shaped axial load magnets 260*a* and 260*b* are magnetically attracted to each other which prevents axial movement of lead screw 250. Ball bearing 264, however, permits rotation of lead screw 250 while maintaining the positional relationship of annular-shaped axial load magnets 260*a*, 260*b*, i.e., slightly spaced apart, which prevents mechanical friction between them while obviously permitting threaded shaft 252 to rotate.

Print head 500 travels in a path along vacuum imaging drum 300, while being moved at a speed synchronous with the rotation of vacuum imaging drum 300 and proportional to the width of a writing swath 450, not shown. The pattern that print head 500 transfers to print media 32 along vacuum imaging drum 300 is a helix.

To provide the necessary registration accuracy required for high-resolution imaging, the present invention moves print head 500 to a fixed registration position at the start of a first pass. Then, for each subsequent pass, print head 500 is moved to the same registration position. The present invention accomplishes this positioning repeatability using a pair of conventional optical sensors that sense corresponding opaque flags. (In the preferred embodiment, these optical sensors are type 1A05HR, manufactured by Sharp Electronics Corporation, having a standard emitter-receiver leg configuration well-known in the art.)

Figure 4:
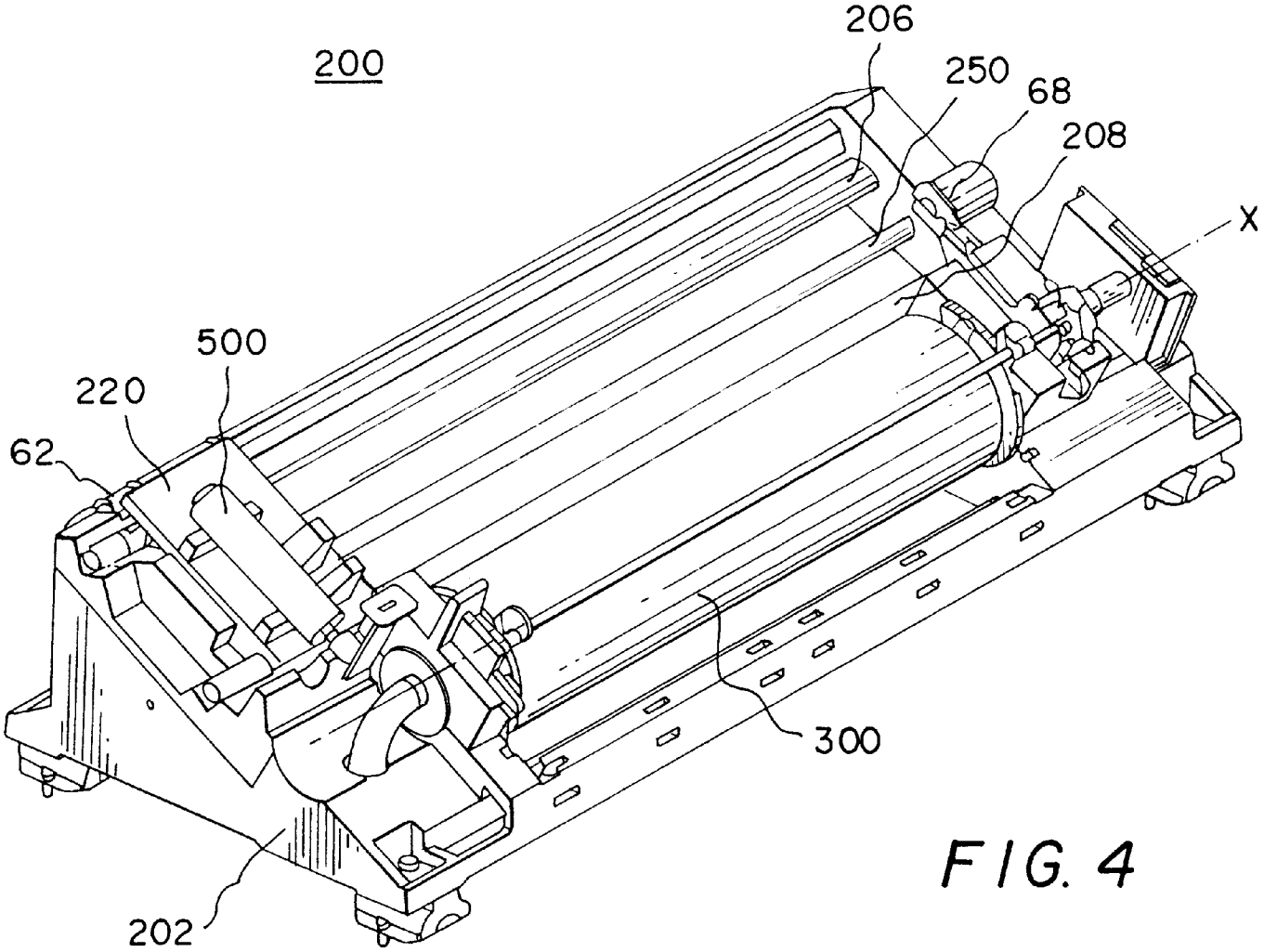
FIG. 4 is a perspective view of the lathe-bed scanning subsystem or write engine of FIG. 2 as viewed from the front of the image processing apparatus.
Figure 5:
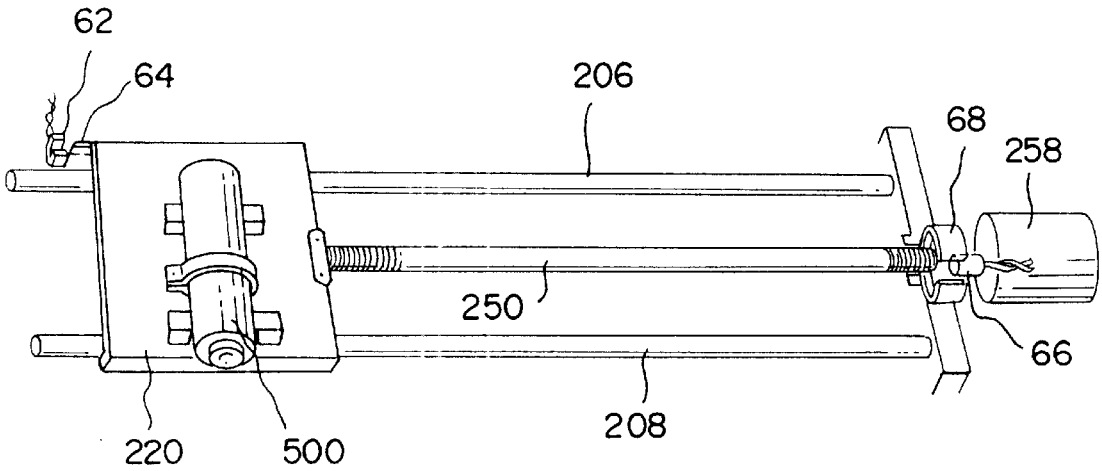
FIG. 5 is a front view showing a relative placement of hardware components us for print head registration in accordance with the present invention.

FIG. 4 shows the relative position of these sensors in lathe-bed scanning subsystem 200. FIG. 5 shows the components of interest for the description of how these sensors operate. As shown in FIG. 4 and more clearly in FIG. 5, a linear sensor 62 is mounted in a stationary position on lathe bed scanning frame 202, in a position that allows it to sense a linear flag element 64 (which serves as a "light shield"), which is mounted on movable translation stage member 220. Linear sensor 62 provides a coarse home signal when it detects linear flag element 64.

Figure 6:
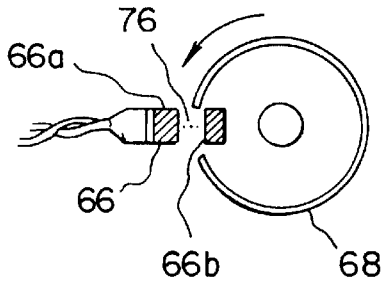
FIG. 6 shows a side view of a rotational flag and a rotational flag sensor provided at the end of the lead screw in accordance with the present invention.

A rotational sensor 66, which can be an optical sensor, is mounted in a stationary position on rotational stop 292 (shown in FIG. 8) at the end of lead screw 250, in a position that allows it to sense a rotary home flag 68. Rotary home flag 68 is mounted on the end of lead screw 250 so that rotary home flag 68 rotates with lead screw 250. In a preferred embodiment of this invention, as shown in FIG. 6, rotary home flag 68 is shaped as an open cylinder with an open notch 76 over one portion of its circumference for detection either of notch 76 or of the opaque section of flag 68 (which serves as a "light shield") formed by the sides of the cylinder by optical rotational sensor 66. Throughout rotation of lead screw 250, rotational sensor 66 continually senses rotary home flag 68. FIG. 6 gives a side view of rotary home flag 68 as it passes between emitter and receiver legs 66*a*, 66*b* of rotational sensor 66.

Figure 7:
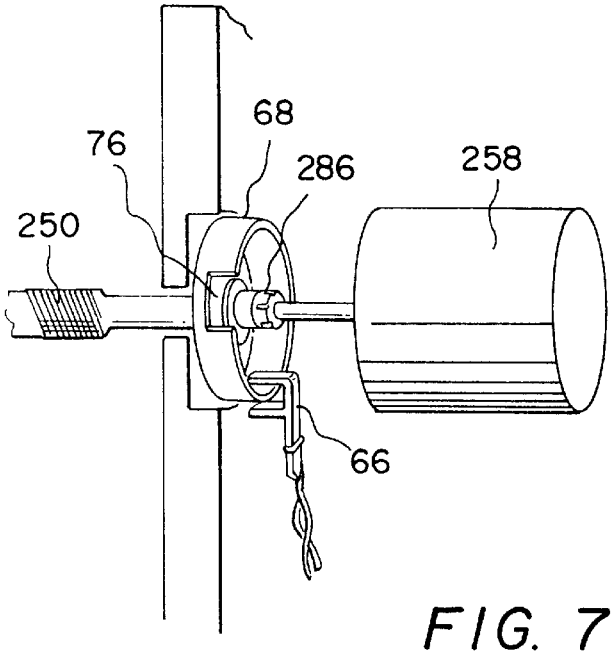
FIG. 7 shows a close-up view of the rotational flag and rotational flag sensor positioned at the end of the lead screw.

FIG. 7 shows the relative positions of rotary home flag 68 and rotational sensor 66, with minor graphic modifications for clarity (the support structure provided by rotational stop 292 is not shown and the shaft of linear drive motor 258 is deliberately elongated to allow visibility of components relevant to this specification).

Because the angular orientation of open notch 76 of rotary home flag 68 provides a flag for fine positioning, it is advantageous to be able to adjust the position of open notch 76 to an optimum setting. To allow this adjustment to be within a few degrees of home position, rotary home flag 68 is designed for mounting on the end of lead screw 250 in one of a discrete number of fixed angular positions (relative to the axis of lead screw 250).

Figure 8:
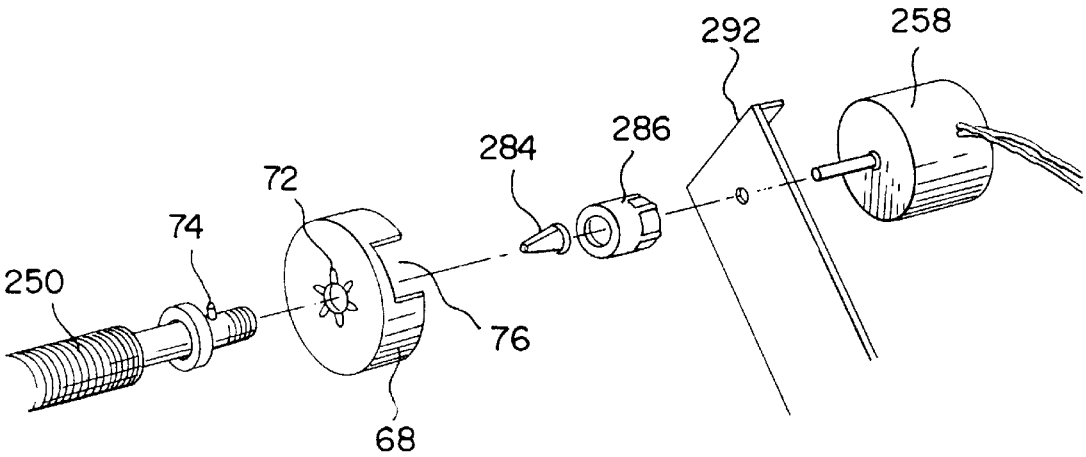
FIG. 8 shows an exploded view of components at the drive end of the lead screw.

Rotary home flag 68 attaches to the end of lead screw 250 as shown in the exploded view of FIG. 8. A collet 284 and a nut collet 286 fasten the shaft of linear drive motor 258 to the end of lead screw 250. Rotary home flag 68 has a fixed number of detents 72, at least one of which mechanically interlocks with at least one pin 74 that is inserted in lead screw 250 at a normal to the axis of lead screw 250 as shown in FIG. 8. Detents 72 are radially positioned circumferentially around a rotational center of flag 68 as shown in FIGS. 8 and 9*b*. This arrangement allows notch 76 of rotary home flag 68 to take one of a fixed number of rotational positions relative to pin 74 position. To adjust rotary home flag 68, it is only necessary to move lead screw 250 out slightly from its mounted position, pull out on rotary home flag 68, to free it from its previous position with one detent 72 at pin 74, and rotate flag 68 to another detent 72 position at pin 74. Rotary home flag 68 can be held magnetically or by other holding means such as clips, springs, screws, etc. Copending application entitled REMOVABLE LEAD SCREW ASSEMBLY FOR AN IMAGE PROCESSING APPARATUS, discloses a self-seating lead screw assembly that is magnetically held in place, so that it can be removed from position without tools. The concept described in this application, is one example of moving lead screw 250 to allow adjustment of rotary home flag 68 without tools.

Figure 9A:
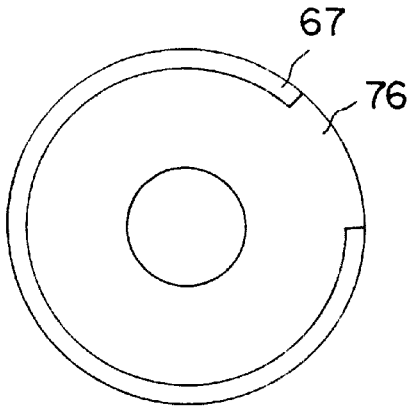
FIGS. 9*a*–9*c*, show respectively, front and rear flat views and a cross-sectional view of the rotational flag.
Figure 9B:
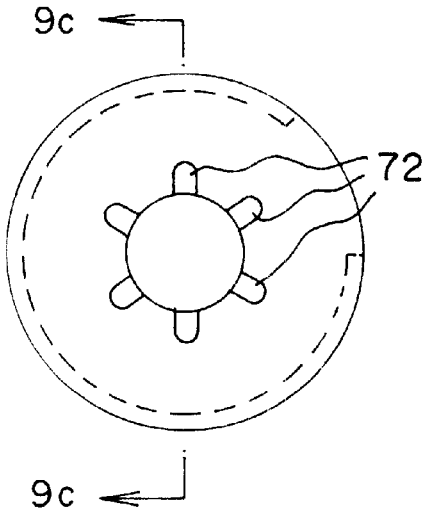
Figure 9C:
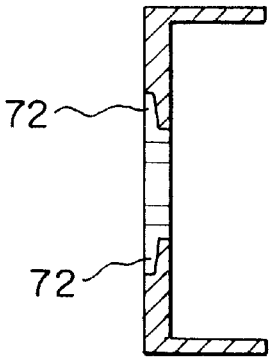

FIGS. 9*a*–9*b* respectively show flat front and rear views of rotary home flag 68 for a preferred embodiment of this invention. Six detent 72 positions are provided, allowing positioning of notch 76 at 60-degree angular increments. (Other arrangements with more or fewer detent 72 positions are possible, depending on the degree of accuracy needed in a specific application.) Cross-sectional view A—A in FIG. 9*c* shows the relative depth of detents 72 in a preferred embodiment of this invention.

Rotary home flag 68 can be magnetically secured to the end of lead screw 250, held tightly in position by its attraction to radial bearing 272 which can be magnetically loaded. It is recognized that rotary home flag 68 can be secured to the end of lead screw 250, by other means such as clips, screws, etc.

It can be seen that this simple mechanical arrangement allows straightforward adjustment of the position of notch 76 for fine-tuning of the home position, both in manufacturing and in field servicing, requiring no tools for its rotational adjustment.

Figure 10:
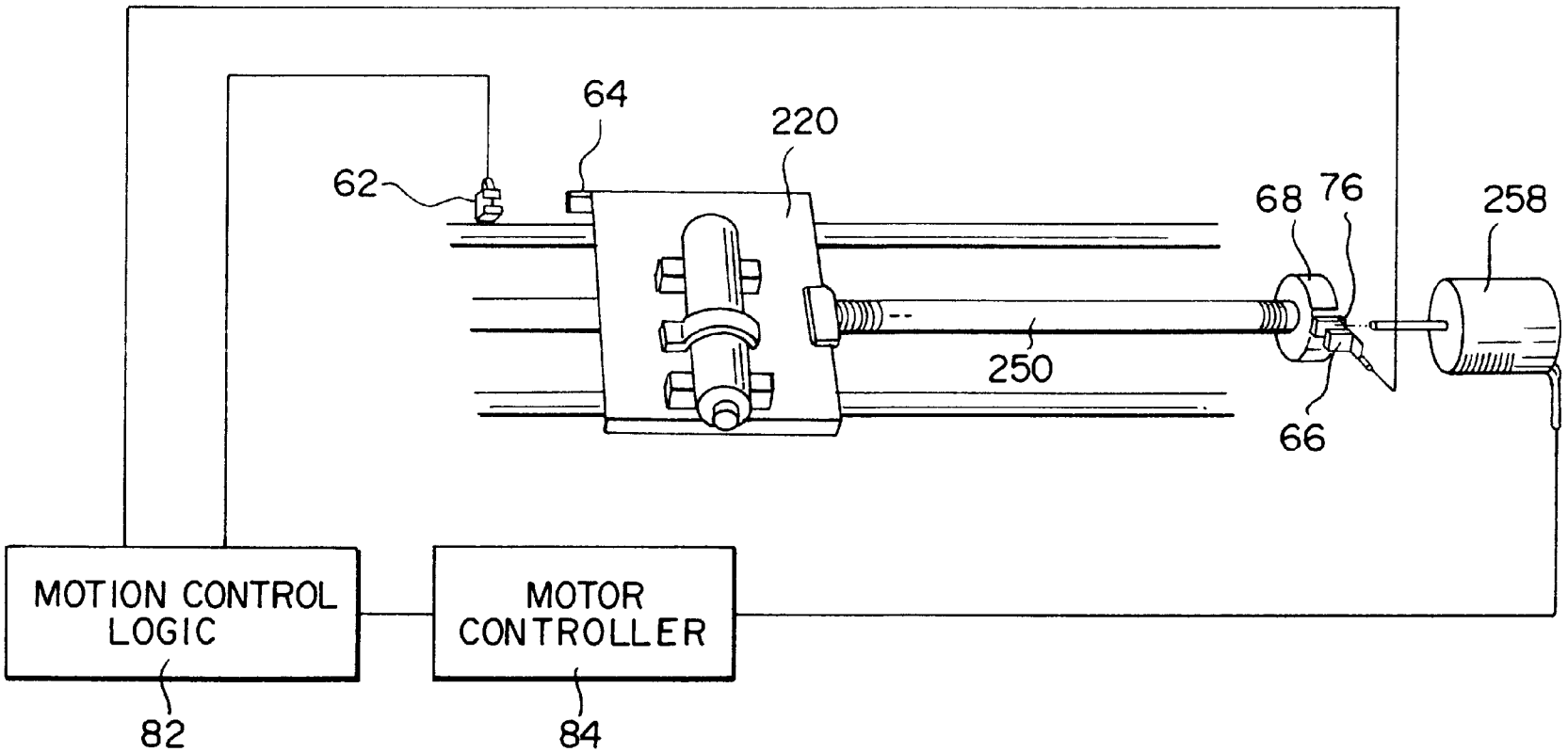
FIG. 10 illustrates the control loop used for print head registration in accordance with the present invention.

FIG. 10 illustrates the basic control loop or control sequence employed for print head registration. A motion control logic 82 is provided by conventional control circuitry, typically microprocessor-based, and is represented here as a standard functional component, well-known in the art. A motor controller 84 is a conventional control for stepper motors. (In the preferred embodiment, this function is provided by a commercially available device such as the IM 2000 High Performance Microstepping Controller from Intelligent Motion Systems, Inc., Taftville, Conn.).

Figure 11A:
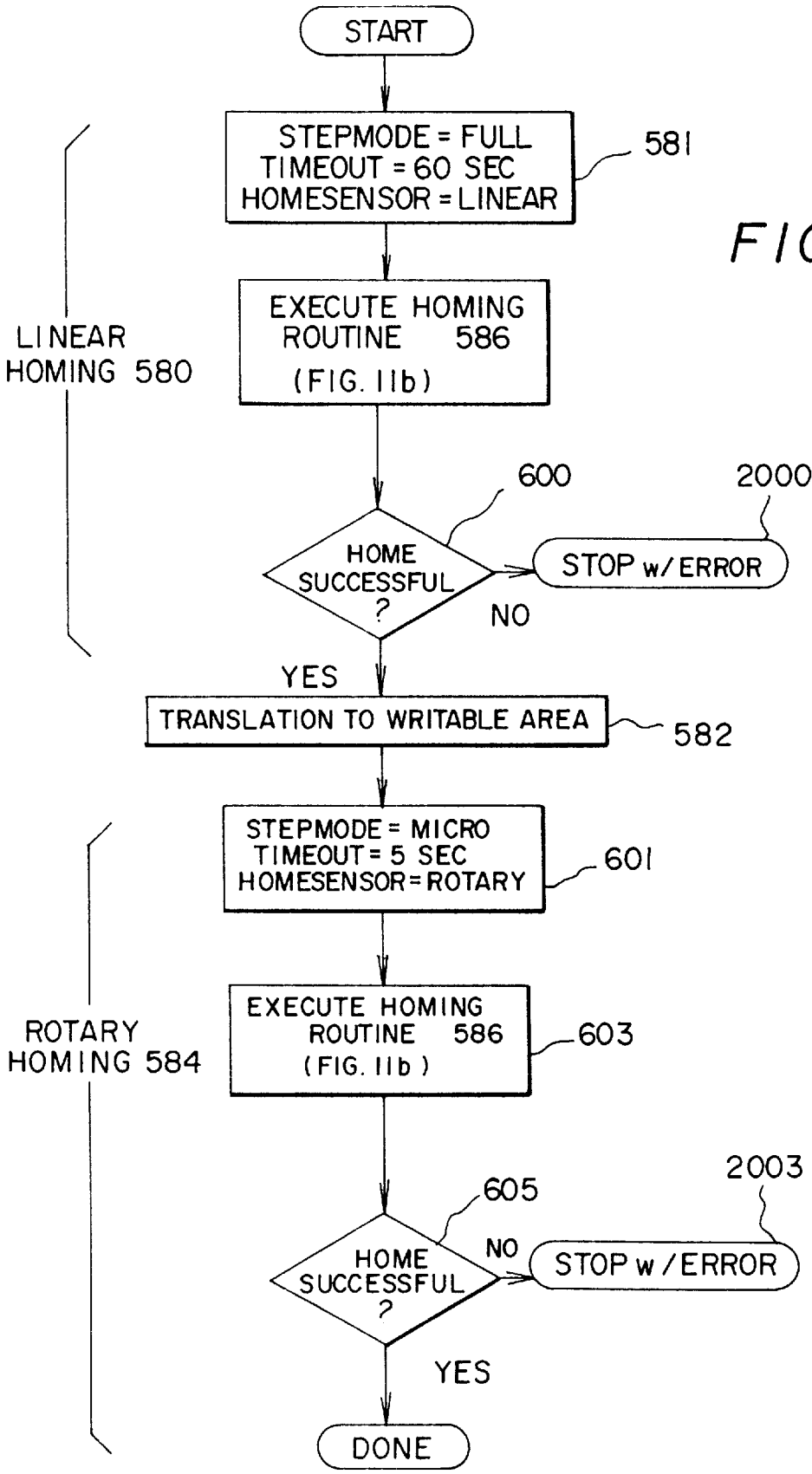
FIGS. 11*a* and 11*b* show a flow chart of a procedure for print head registration in accordance with the present invention.
Figure 11B:
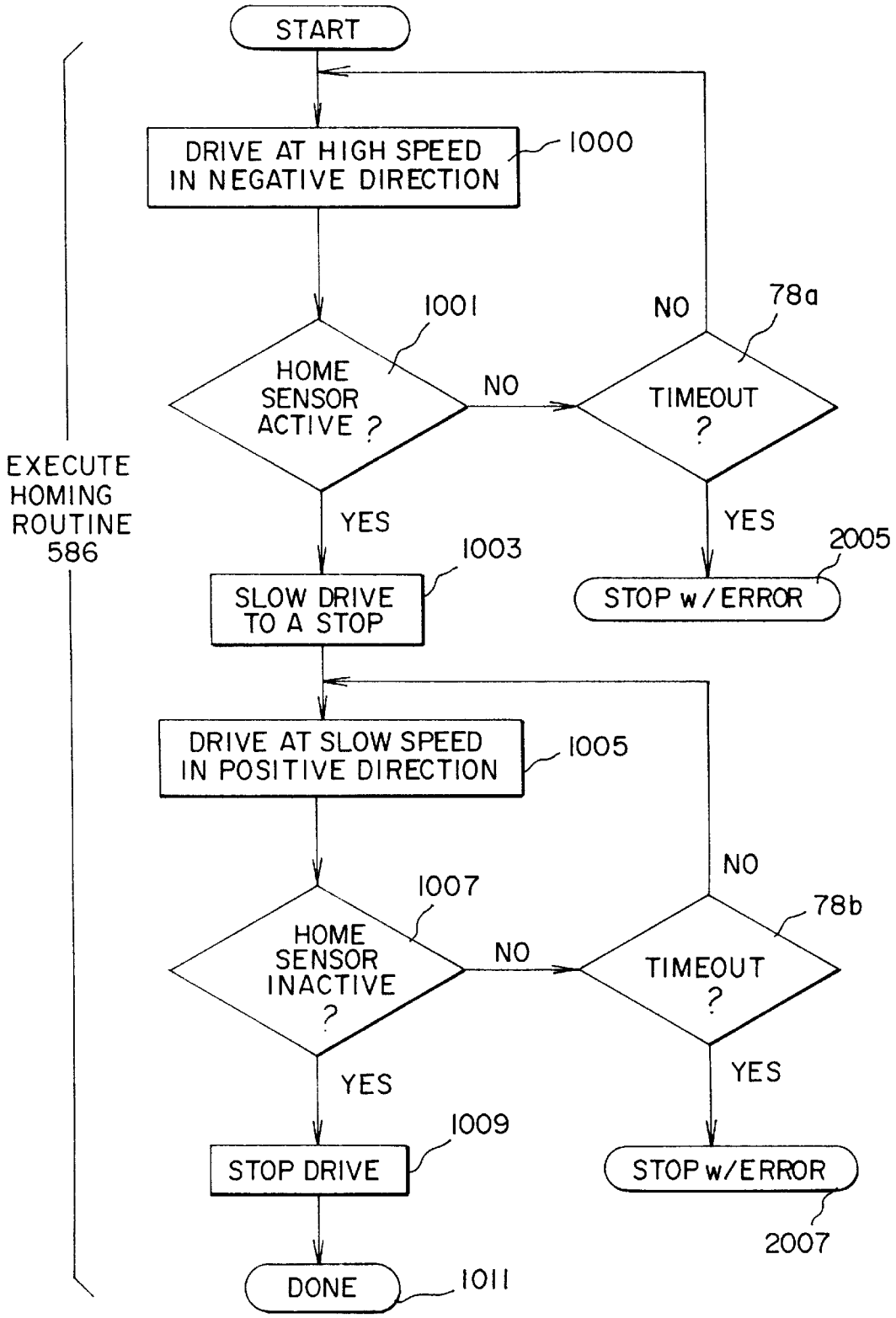

FIGS. 11*a*–11*b* show the sequence of steps used to register print head 500, in flow-chart format. FIG. 11*a* shows the complete process that has three major parts: a linear homing 580, a translation to writable area 582, and a rotary homing 584. FIG. 11*b* shows an execute homing routine 586, and a sub-process which runs twice during registration, once during linear homing 580 and once during rotary homing 584.

Linear drive motor 258, a stepper motor, runs in either full-step or microstepping mode during the registration sequence. As is well-known in the art, full-step mode provides fast speed and highly accurate, stable positioning at discrete, incremental angles of the stepper motor shaft. (In a preferred embodiment of this invention, the stepper motor has 400 steps per revolution so that each step moves the motor shaft 0.9 degrees.) In a microstepping mode, the stepper motor runs slowly, but allows a higher resolution, so that angular positions between the discrete increments provided by full-step mode can be reached. (In a preferred embodiment of this invention, the stepper motor has 64 microsteps per step, so that each microstep moves the motor shaft 0.014 degrees.)

Referring to the steps in FIG. 11*a*, to register print head 500, motion control logic 82 first executes linear homing 580. Motion control logic 82 initially sets linear drive motor 258 to run in full-step mode and sets a timeout value (60 sec in the preferred embodiment) for achieving a linear home reference position (step 581). Motion control logic 82 then runs an execute homing routine 586 to cause linear drive motor 258 to run at high speed in the negative direction (step 1000) (that is, to the left as viewed in FIG. 10) and drive print head 500 rapidly toward a position that is just past the edge of vacuum imaging drum 300, at linear sensor 62 (FIG. 11*b*). At step 1001 of FIG. 11*b* it is determined if linear sensor 62 is active. Linear sensor 62 is active when tripped, that is, when it detects linear flag element 64. When linear sensor 62 is tripped (answer yes to step 1001), motion control logic 82 slows linear drive motor 258 to a stop (step 1003). Motion control logic 82 now reverses the direction of linear drive motor 258 to drive print head 500 in the opposite (or positive) direction (step 1005), one full-step at a time, until linear sensor 62 goes inactive (step 1007) indicating sensing of the edge of linear flag element 64. The motor is stopped (step 1009) at the very next full-step position following detection of the edge of linear flag element 64. At this point, linear homing 580 is complete (step 1011, FIG. 11*b*; step 600, FIG. 11*a*).

Next, motion control logic 82 executes translation to writable area 582. Again moving in the positive direction, this moves print head 500 back, a precise number of full steps (15,200 full steps in the preferred embodiment, however, the number of full steps depends on the screw pitch and where the flag is located), to a position from which print head 500 could write to media on vacuum imaging drum 300. At this point, translation to writable area 582 is complete. Print head 500 is now very near (i.e., within one revolution of the lead screw) its registration position.

Next, motion control logic 82 executes rotary homing 584. Motion control logic 82 now sets linear drive motor 258 to run in a microstepping mode and sets a timeout value (5 sec in the preferred embodiment) for achieving a rotational home reference position (at which point, print head 500 will be registered) (step 601). Motion control logic 82 again runs execute homing routine 586 (step 603), this time for rotary homing 584. Running linear drive motor 258 at high speed for microstepping mode (which is much slower than high speed for full-step mode, as described above) and in the negative direction (step 1000), motion control logic 82 now monitors rotational sensor 66, which is active when tripped (step 1001), that is, when it detects the opaque ("light shield") portion of rotary home flag 68. As soon as rotational sensor 66 is tripped, motion control logic 82 slows linear drive motor 258 to a stop (step 1003). Motion control logic 82 now reverses the direction of linear drive motor 258 to rotate very slowly in the opposite (positive) direction (step 1005), one microstep at a time, until rotational sensor 66 goes inactive (step 1007) indicating sensing of the edge of notch 76 in rotary home flag 68. The motor is stopped (step 1009) at the microstep position at which rotational sensor 66 transitions from active to inactive. Print head 500 is now at its registration position, ready to image the first pixel for the color separation of interest (step 1011, FIG. 11*b*; step 605, FIG. 11*a*). As the flowchart of FIGS. 11*a*–11*b* show, the logic sequence for print head 500 registration includes standard error-checking using timeouts 78*a*, 78*b*, as is well-known in the art. As shown in FIG. 11*a* if homing is not successful, (steps 600, 605) the present invention provides for stop with error steps 2000 and 2003. Stop with error steps 2005, 2007 (FIG. 11*b*) are also provided after the time out checks (steps 78*a*, 78*b*). As an example, stop with errors could occur due to either a failure of the sensors, a mechanical binding problem, or an electrical drive problem with the motor.

At the conclusion of translation to writable area 582, the optimum position for rotary home flag 68 is with notch 76 at rotational sensor 66 position (here, rotational sensor 66 "detects" notch 76). FIG. 10 shows notch 76 in the preferred position for the conclusion of translation to writable area 582, relative to the emitter-receiver legs 66*a*, 66*b* of rotational sensor 66. (Because rotary homing 584 uses relatively slow microstepping of linear drive motor 258 for sensing the edge of notch 76, the registration process runs fastest when linear drive motor 258 only needs to microstep over a short distance.) A timeout occurring during threshold check 78*a* of the rotary homing may indicate that notch 76 is not in the optimum position. Motion control logic 82 reports this error condition to the manufacturing or service operator, who can then shift the position of rotary home flag 68 to re-position notch 76 appropriately, such that the notch is close enough to allow rotary homing to complete in less than 5 sec.

The invention has been described with reference to preferred embodiments thereof. However, it will be appreciated and understood that variations and modifications can be effected within the spirit and scope of the invention as described herein above and as defined in the appended claims, by a person of ordinary skill in the art, without departing from the scope of the invention. For example, the shape of a rotary home flag could be altered (as a flat plate with the notch over a portion of its circumference, as one example), or its number of discrete positions could be changed from that of the preferred embodiment as described above. The rotary home flag could alternately be mounted at either end of the lead screw shaft. Specific timeout or full-step values could be changed as needed to meet different dimensional requirements. This invention could also be applied to an apparatus that uses any of a number of types of colorant, such as dyes, inks, and pigments. It should also be noted that the registration sequence could alternately operate linear drive motor 258 in half-step mode instead of full-step mode.

What is claimed is:

1. An image processing apparatus comprising:

a writing assembly operationally associated with a lead screw mechanism so as to be movable in a travel path along the lead screw mechanism;

a motor which rotates the lead screw mechanism so as to move said writing assembly along said travel path;

a linear sensor arrangement which detects a presence of said writing assembly at a reference point along said travel path and provides a first signal indicative thereof;

a rotational sensor arrangement which detects a rotational orientation of said lead screw mechanism with respect to a fixed angular position and provides a second signal indicative thereof;

a controller which receives said first and second signals and controls said motor in response thereto to control a positioning of said writing assembly along said travel path;

wherein said rotational sensor arrangement comprises a first rotational sensing device mounted on an end of said lead screw mechanism so as to be rotatable with said lead screw mechanism, and a second rotational sensing device mounted on a rotational stop member at the end of said lead screw mechanism at a position where it permits said second rotational sensing device to sense said first rotational sensing device; and wherein said first rotational sensing device is an open cylinder which rotates with said lead screw mechanism, said open cylinder having an open notch over a portion of its circumferential wall, and said second rotational sensing device comprises an emitter leg and a receiver leg, said second rotational sensing device being positioned so that said circumferential wall and said open notch of said first rotational sensing device pass between said emitter leg and said receiver leg when said first rotational sensing device is rotated upon a rotation of said lead screw mechanism.

2. An apparatus according to claim 1, wherein:

said writing assembly and said lead screw mechanism are mounted on a frame; and said writing assembly comprises a translation member and a print head mounted on said translation member.

3. An apparatus according to claim 2, wherein said linear sensor arrangement comprises a first linear sensing device mounted on said frame and a second linear sensing device mounted on said translation member.

4. An apparatus according to claim 3, wherein said second linear sensing device is a linear flag element which acts as a light shield.

5. An apparatus according to claim 1, wherein said first rotational sensing device is a rotary home flag which rotates with said lead screw mechanism.

6. An apparatus according to claim 5, wherein said rotary home flag comprises a plurality of detents and said end of said lead screw mechanism comprises at least one pin, such that said rotary flag can be located at a plurality of rotational positions relative to said at least one pin by mechanically interlocking one of said detents with said at least one pin.

7. An apparatus according to claim 1, wherein said motor is a stepper motor.

8. An image processing apparatus that uses a scanning head mounted on a translation assembly, said translation assembly being movable in opposite directions along a lead screw, said image processing apparatus comprising:

a stepper motor that rotates said lead screw in opposite rotational directions;

a controller which selectively drives said stepper motor in at least full-step and microstepping modes;

a linear sensing arrangement which detects an arrival of said translation assembly at a reference point along a linear travel path of said translation assembly; and a rotational sensing arrangement which detects a rotational orientation of said lead screw relative to a fixed angular position;

wherein said rotational sensing arrangement comprises:

a photo interrupter device;

a light shield mounted on a shaft of said lead screw, said light shield cooperating with said photointernupter device to change a sensed state of said photo interrupter device at an angular position of said lead screw; and wherein said light shield is mountable on said lead screw shaft in any one of a plurality of fixed positions, which is determined by a detent provided in said light shield, said detent mating with a corresponding pin seated in said lead screw shaft, such that each position of said light shield indicates a discrete angular position of said lead screw.

9. An apparatus according to claim 8, wherein said position of said light shield is manually adjustable, so that said light shield can be rotated to a desired position.

10. An apparatus according to claim 8, wherein said light shield is magnetically held in position against said lead screw shaft.

11. An apparatus according to claim 8, wherein said controller can selectively drive said stepper motor in a half-step mode.

* * * * *